US006491433B2

(12) United States Patent
Shabram, Jr. et al.

(10) Patent No.: US 6,491,433 B2
(45) Date of Patent: Dec. 10, 2002

(54) BAG WITH VENTING MEANS

(76) Inventors: Lyle F. Shabram, Jr., 71 Rancho Rd., Carmel Valley, CA (US) 93924; Richard C. Harris, 3292 Jackson Hwy., Chehalis, WA (US) 98532

( * ) Notice: Subject to any disclaimer, the term of this patent is extended or adjusted under 35 U.S.C. 154(b) by 0 days.

(21) Appl. No.: 09/757,312

(22) Filed: Jan. 8, 2001

(65) Prior Publication Data

US 2001/0021281 A1 Sep. 13, 2001

Related U.S. Application Data

(63) Continuation-in-part of application No. 09/173,709, filed on Oct. 15, 1998, now Pat. No. 6,170,985.
(60) Provisional application No. 60/062,050, filed on Oct. 15, 1997.

(51) Int. Cl.[7] ..... B65D 33/01
(52) U.S. Cl. ..... 383/100; 383/107
(58) Field of Search ..... 383/100, 107, 383/101, 44; 426/118

(56) References Cited

U.S. PATENT DOCUMENTS

| | | | | | |
|---|---|---|---|---|---|
| 3,494,457 | A | * | 2/1970 | Titchenal | 206/484 |
| 3,516,217 | A | * | 6/1970 | Gildersleeve | 383/100 X |
| 3,537,455 | A | * | 11/1970 | Skyles et al. | 383/100 |
| 4,323,586 | A | * | 4/1982 | Long | 206/484 |
| 4,470,152 | A | * | 9/1984 | Blankenship | 383/37 |
| 4,834,554 | A | * | 5/1989 | Stetler et al. | 383/100 |
| 6,170,982 | B1 | * | 1/2001 | Shabram, Jr. et al. | 383/100 |
| 6,214,392 | B1 | * | 4/2001 | Ramirez | 383/100 X |

FOREIGN PATENT DOCUMENTS

| | | | | |
|---|---|---|---|---|
| FR | 001367922 | * | 6/1964 | 383/100 |
| FR | 2224356 | * | 10/1974 | 383/100 |
| JP | 0139352 | * | 5/1990 | 383/100 |
| NZ | 296110 | | 8/1998 | |

OTHER PUBLICATIONS

US 5,825,471, 10/1998, Mazion et al. (withdrawn)*
Translation of Japanese patent document (document No. JA 0139352 which was cited in the Oct. 12, 2001 form PTO–892).*

* cited by examiner

*Primary Examiner*—Jes F. Pascua
(74) *Attorney, Agent, or Firm*—Oppenheimer Wolff & Donnelly LLP; Claude A. S. Hamrick

(57) ABSTRACT

A vented bag includes a length of tubular gas-impervious material sealed to closure at at least one end thereof by a plurality of spaced apart seal lines each including a discontinuity proximate one end thereof. The discontinuities in adjacent ones of the seal lines are disposed proximate opposite ends of the lines so that the discontinuities, the lines and the adjoining material form a tortuous channel providing communication between the interior of the bag and the exterior of the bag.

6 Claims, 8 Drawing Sheets

BAG WITH VENTING MEANS

RELATED APPLICATIONS

This application is a continuation-in-part of our application No. 09/173,709, filed Oct. 15, 1998 having the same title, to be issued as U.S. Pat. No. 6,170,985 on Jan. 9, 2001, which claims the benefit of Provisional application Ser. No. 60/062,050, filed Oct. 15, 1997.

BACKGROUND OF THE INVENTION

1. Field of the Invention

This invention relates generally to commodity bags, and more specifically to a sealable commodity bag including a venting means allowing for air to escape from the bag after closure.

2. Description of the Prior Art

Commodity bags are widely used in industry for storing a variety of dry powdery or granular products. Food products such as powdered milk and the like require a closure that resists moisture and contaminants from entering the bag. Most of the commodity bags commonly used for dry foods include an interior plastic bag or liner combined with several outer plies of paper. Such bags are formed by folding flat material into a tube with overlapping margins and sealing the margins together with heat seals or glues, then folding and sealing one end of the tube to form a bag, which is then similarly folded and sealed at the other end after filling. The multiple plies of paper with the plastic result in a very strong and burst resistant container that may be air tight.

One problem that arises from this type of container is that air and possible other gasses may be easily trapped within the bag along with the contents. Several condiment bags have been developed that allow air to escape after closure. Some of the methods used in these designs somewhat discourage moisture and contaminants from entering the bags.

Perry (U.S. Pat. No. 3,302,859) discloses a method allowing air to pass through crescent shaped holes in a bag. The most effective version of this bag locates the cuts, or vents, along the margin of overlapping materials and between two heat seals wherein the vents formed through one layer of the overlapping margins are misaligned with the vents formed through the opposing layer. The intention is that the opposing layer of material will lie against and thereby are off the vents once air is pressed from the bag. This design is problematic in that the flexibility and distortability of the plastic material, and the repeated handling of the bag all effect the reliability of this method especially where the contents can easily pass through the vents.

Kenan (U.S. Pat. No. 4,470,153) discloses an improvement in venting where a strip of paper or filter like material is sealed within the margin between two seals. The filter material is then incorporated into the end seals thereby creating a filtered path for air to pass. The practicality of this design comes into question as well as the ease of manufacturing. This design may also encourage moisture to enter the bag if the filter is absorbent.

Keppel (Pat. No. 4,550,441) provides a more practical and practiced method wherein channel formed between two heat seals along overlapping margins include distally separated vent holes formed through each of the overlapping layers, wherein one of the vent holes is formed through the inner layer (into the bag interior) and the other vent hole is formed through the outer layer. Air, contents, and contaminants must travel a course through the channel to enter or exit the bag. The relative effectiveness of this method is proven in practice, though the vent holes must be punctured through the bag, and the puncture holes are small and easily obstructed.

By careful examination of these methods, it should be clear that the further the distance that separates the vent holes, the more effective the method. It can also be concluded that the effectiveness of these methods to inhibit or prevent the entry of contaminants and moisture and the re-entry of air can be influenced by the distortions, movement, turning and positioning of the bag relative to gravitational and other forces to which the bag and it's contents may be subjected.

What is needed is an improved vented bag that does not require punctured or cut holes through the bag surface.

What is also needed is a sealed bag with an improved means of venting which discourages or greatly inhibits the movement of moisture and particles through the venting means especially where the bag may be subjected to turning, handling and forces of nature.

SUMMARY OF THE INVENTION

It is an object of the present invention to provide an improved vented bag that does not require punctured or cut holes through the bag surface.

It is also an object of the present invention to provide a sealed bag with and improved means of venting the bag where a plurality of seals are included along the length of overlapping margins, and where the seals are non-continuous in that strategically located open spaces along the seals cause the seals to form a maze-shaped channel with at least one open space providing communication with the interior of the bag and at least one open space providing communication with the exterior of the bag.

Another object of the present invention is to provide a vented bag with a maze-shaped channel, or tortuous path, to allow communication between the interior and exterior of the bag wherein the maze-shaped channel forms a relatively long and multi-directional path which discourages or greatly inhibits the movement of moisture and particles through the channel especially where the bag may be subjected to turning, handling and forces of nature.

Furthermore, it is an object of the present invention to provide a bag such as a commodity bag that includes a relatively long and narrow maze-shaped channel allowing for the evacuation of air from the bag wherein the bag interior layer and included channel are manufactured from flexible plastic film and wherein the layers of film forming the channel will, in their natural state and after the evacuation of air from the channel, tend to lie flatly together thereby closing the channel to the re-entry of air into the channel.

Yet another object of the present invention is to disclose a method of manufacturing a vented bag with a plurality of non-continuous seals specifically spaced to form a maze-shaped channel that provides communication between the interior and the exterior of the bag. These and other objects and advantages will become apparent from the following drawings and description.

Briefly, a presently preferred embodiment of the present invention includes a vented bag including at least one rectangular sheet of substantially gas-impervious material having a top edge, a bottom edge opposite said top edge, and a first side edge folded over an opposite second side edge to form a tube. The tube has a longitudinal seam including at least first and second overlapping sheet portions joined together along a plurality of seal lines extending longitudinally from said top edge of said sheet to said bottom edge of said sheet. The bag is sealed to closure at one end of said tube. Each of the plurality of seal lines includes a discontinuity proximate one of the top and bottom edges of the sheet. The discontinuities in adjacent ones of the seal lines are disposed proximate opposites ones of the top and bottom edges of the sheet such that the plurality of seal lines, the discontinuities, and the first and second overlapping sheet portions form a tortuous channel providing communication between the interior of the bag and the exterior of the bag.

In an alternative embodiment, the starting material for the bags are tubular and the tortuous channel is disposed in the closure formed in at last one end thereof.

An important advantage of the present invention is that the maze-shaped channel, or tortuous path, allows communication between the interior and exterior of the bag wherein the maze-shaped channel discourages or greatly inhibits the movement of moisture and particles through the channel especially where the bag may be subjected to turning, handling, and forces of nature.

The foregoing and other objects, features, and advantages of the present invention will be apparent from the following detailed description of the preferred embodiment which makes reference to the several figures of the drawing.

IN THE DRAWINGS

Figure 7:
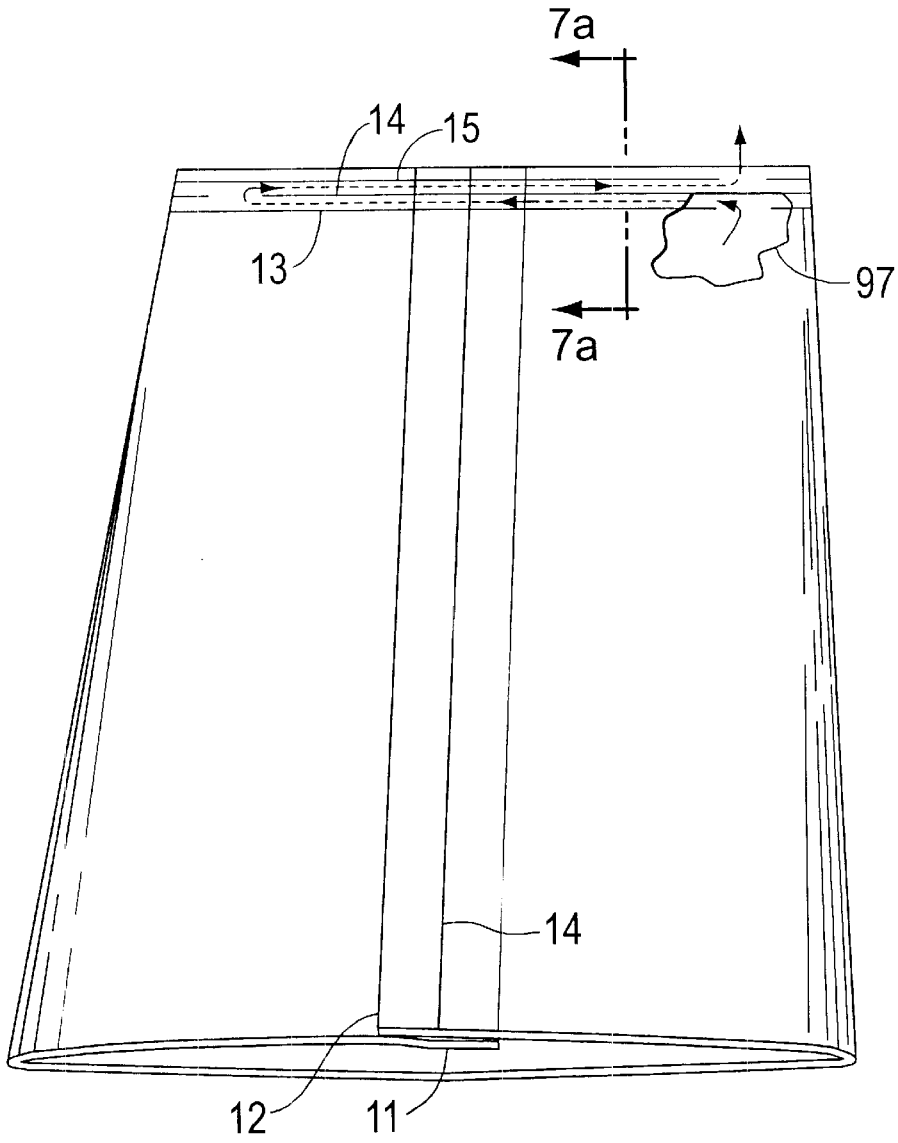
FIG. 7 is a perspective view showing an alternative embodiment of this invention.
Figure 7A:
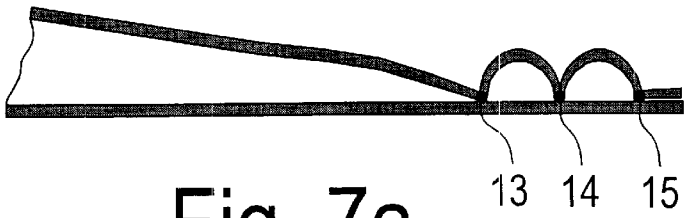

FIG. 7*a* is a cross section taken along the line 7*a*—7*a* in FIG. 7.

DETAILED DESCRIPTION OF THE PREFERRED EMBODIMENTS

Figure 1:
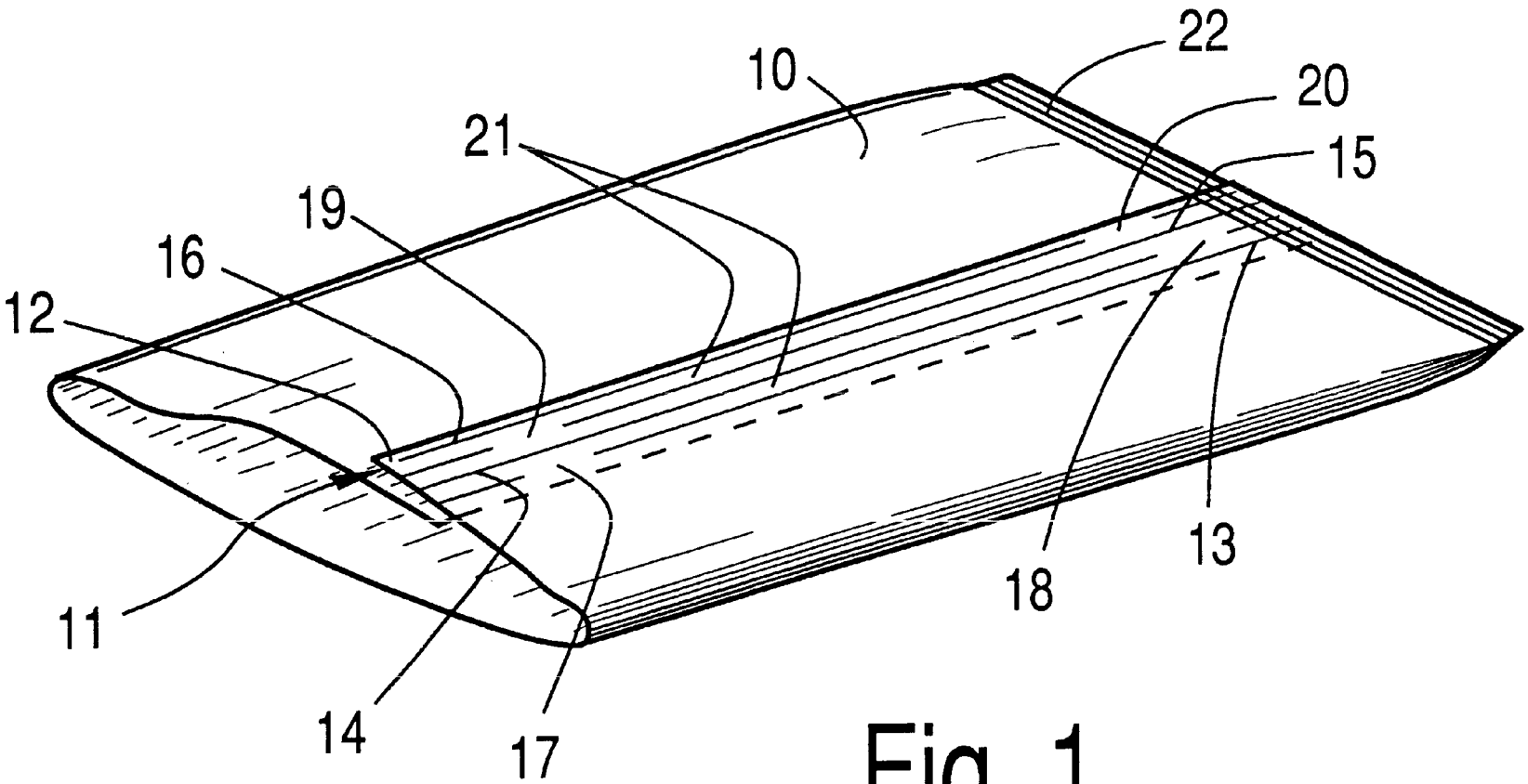
FIG. 1 is a perspective view illustrating a bag according to the present invention open at one end.
Figure 2:
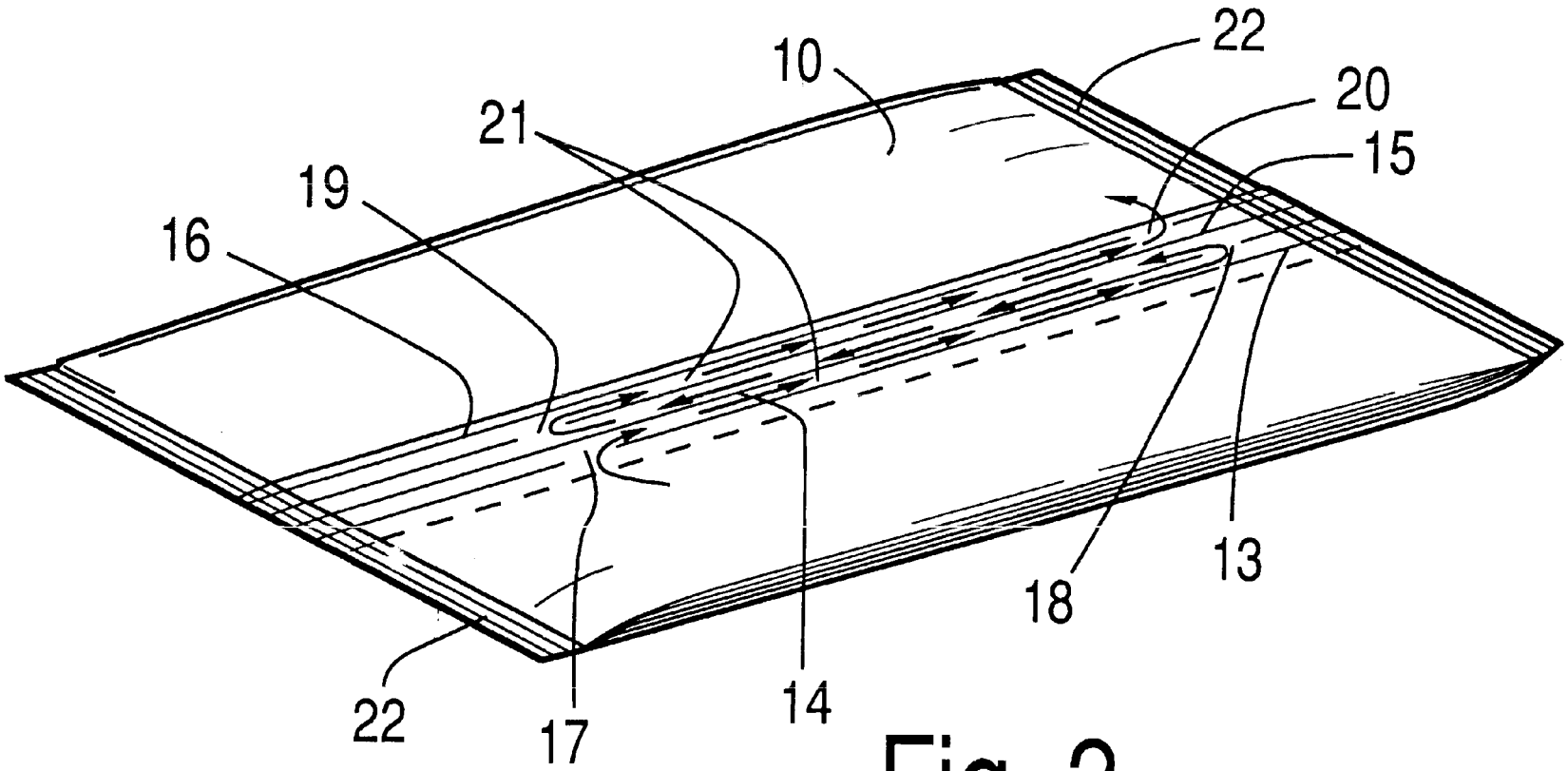
FIG. 2 is a perspective view of a bag according to the present invention closed at both ends showing a path of air through a channel.

Referring now to the drawings, FIG. 1 shows a perspective view illustrating a bag 10 formed from flexible and sealable plastic film such as polyethylene (FIG. 4) by overlapping the edges of the film to form margins 11 and 12. Between the margins and running along its length are located a series of non-continuous seals 13, 14, 15, and 16. Cross seals 22 in FIG. 1 and FIG. 2 seal all of the layers of film together at either end of the bag 10. The non-continuous portion of the seals 13–16 form openings 17, 18, 19, and 20. As illustrated, the seals and openings form a maze-shaped channel 21. As shown in FIG. 1, and demonstrated with arrows in FIG. 2, opening 17 provides communication between the channel 21 and the interior of the bag 10; opening 18 and 19 provide communication between the portions of the channel 21 between seals 13, 14, 15, and 16; opening 20 provides communication between the channel 21 and the interior of the bag 10. It can be seen that by locating openings 17 and 19 adjacent to each other and toward one end of the bag 10 and locating openings 18 and 20 adjacent to each other and at the opposite end of the bag 10, a channel several times longer than the bag can be achieved. Also, as clearly demonstrated in FIG. 2, the channel 21 follows a pathway that changes direction several times along its course.

It should be appreciated that any materials that may enter the channel either at 17 or 20 must traverse this long and multi-directional pathway to pass completely through the channel 21. It can be further appreciated that any such materials would most likely be trapped at either end of some interior portion of the channel (somewhat like the trap in a drain pipe), especially where the bag is turned or stood on its end. Obviously if the channel is relatively narrower in dimension, then air pressure created in an effort to force air out of the bag can cause the layers of film to separate enough to allow the air to move through the channel. However, the natural state of the layers of film, and in fact any expansion of volume at the interior of the bag that would cause the layers of film to close more tightly together, would also inhibit the movement of moisture and materials through the channel. The layers of film in effect create a closing one-way valve. Likewise, any folds or distortions in the bag would create kinks and bends in the channel that would only add to prevent movement of materials through the channel.

Because the layers of film can form a natural valve or otherwise obstruct the movement of air through the channels, in an embodiment of the present invention, a hot melt adhesive is used to seal the layers where the bead of hot melt adhesive tends to separate the layers of film, especially along the edge of the bead.

Figure 5:
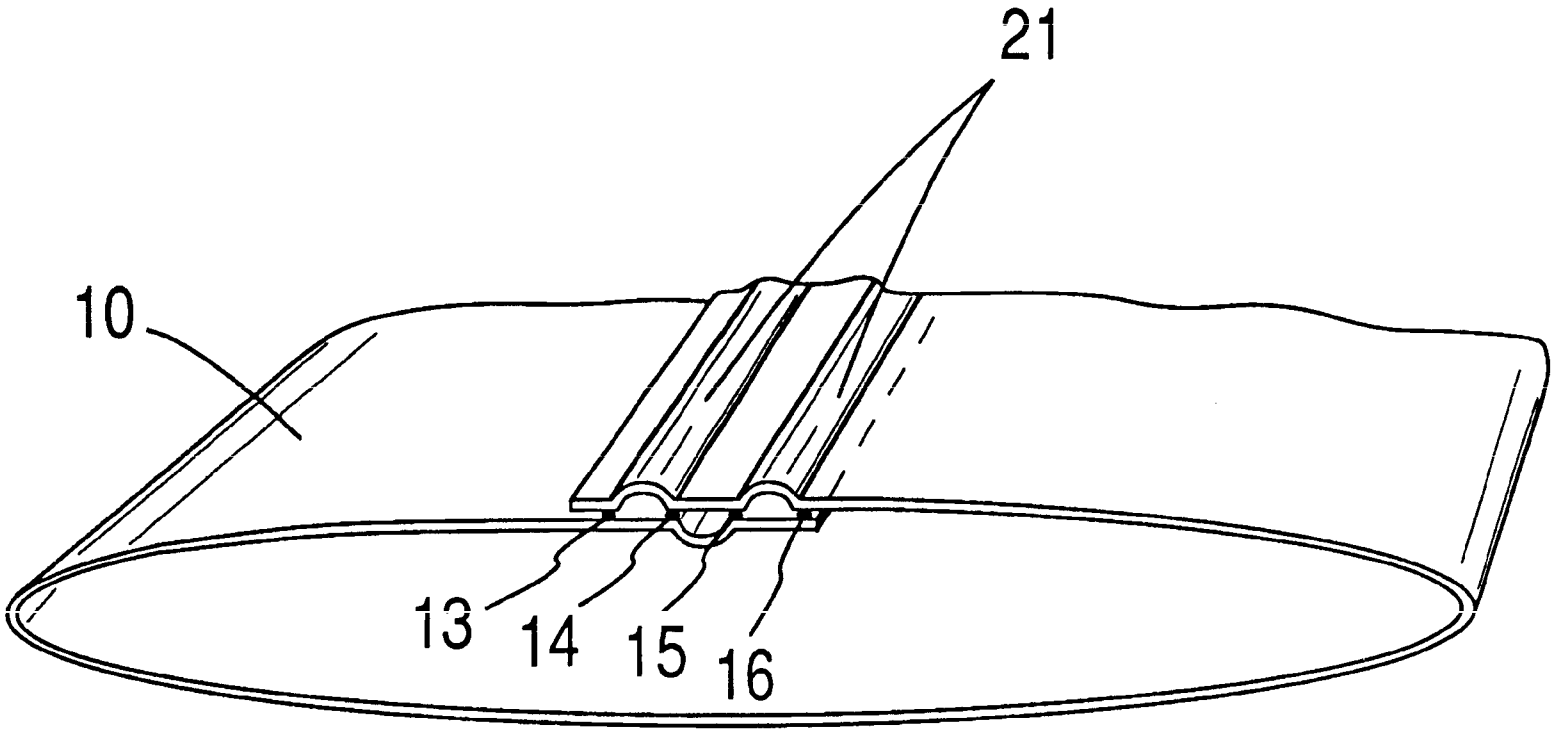
FIG. 5 is a perspective view illustrating a first alternative embodiment of a bag according to the present invention having channels with an open passageway.

Another solution to this problem is shown in FIG. 5, wherein the width of one of the layers of film between the seals is greater than the opposing layer. This configuration limits the ability of the two opposing layers of film to lie flatly together by creating a bubbling effect to help maintain an open channel.

Figure 3:
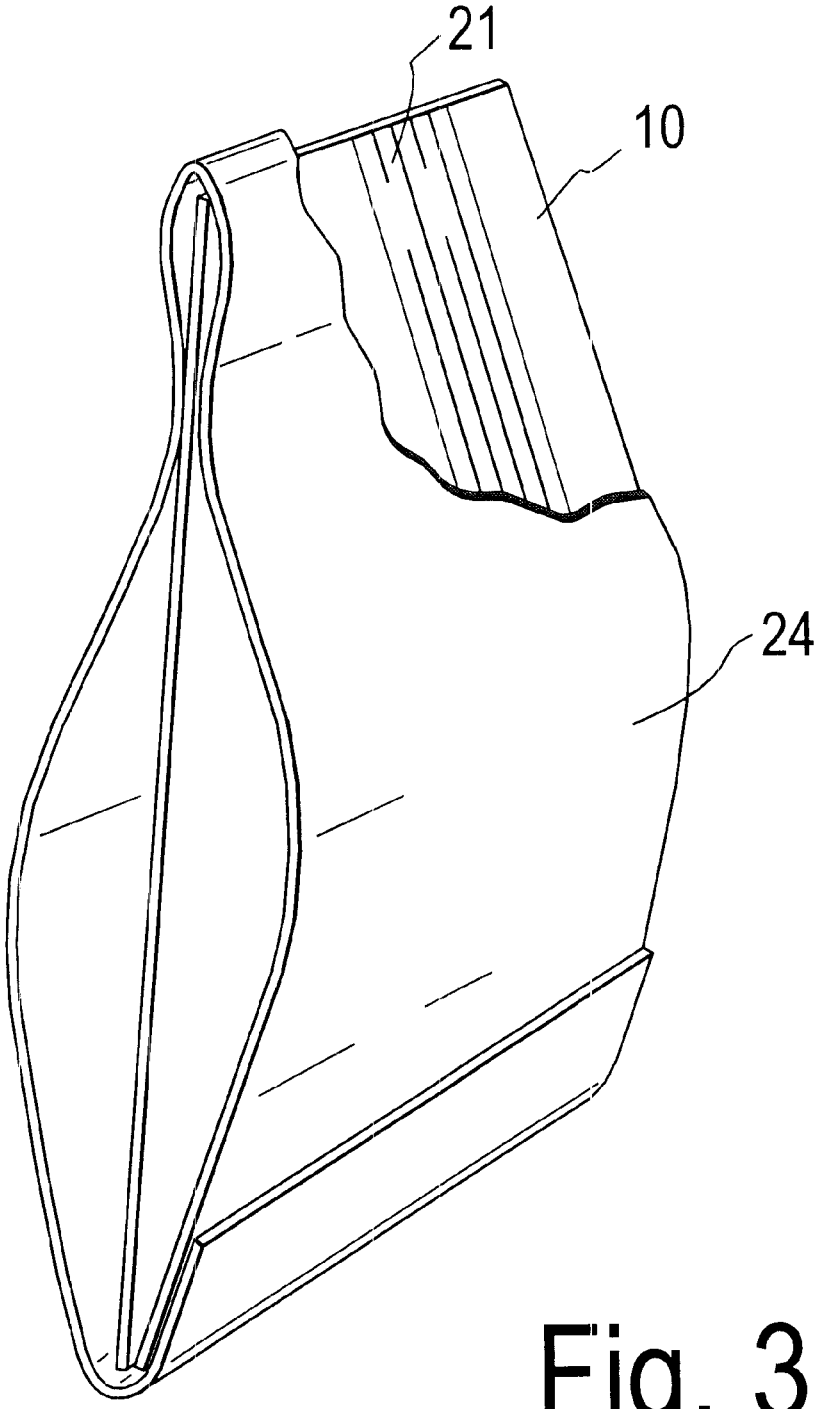
FIG. 3 is a perspective view illustrating a gusseted commodity bag according to the present invention with a cut away portion to expose the bag as an interior ply.

In a manufacturing process such as the one disclosed in this invention, rods with semi-circular cross sections, or similar, could extend between the layer of the moving web of film during the sealing process causing the configuration as shown in FIG. 5. The figures and specifications of this invention disclose a venting channel formed by four parallel heat seals. It should be clear that two or more seals would be sufficient to demonstrate the invention though four would be preferred. It should also be noted that the seals need not be parallel nor do they need to be heat seals. It is intended that any method of manufacturing or reconfiguration of the seals and openings fall within the scope of this invention. FIG. 3 demonstrates how the bag may be incorporated into a commodity bag 24 by forming the inner ply or inner bag. In this case, the bag is gusseted emphasizing the fact that the means disclosed in this invention may be adapted to but not limited to use with any commercially produced commodity bags.

Figure 4:
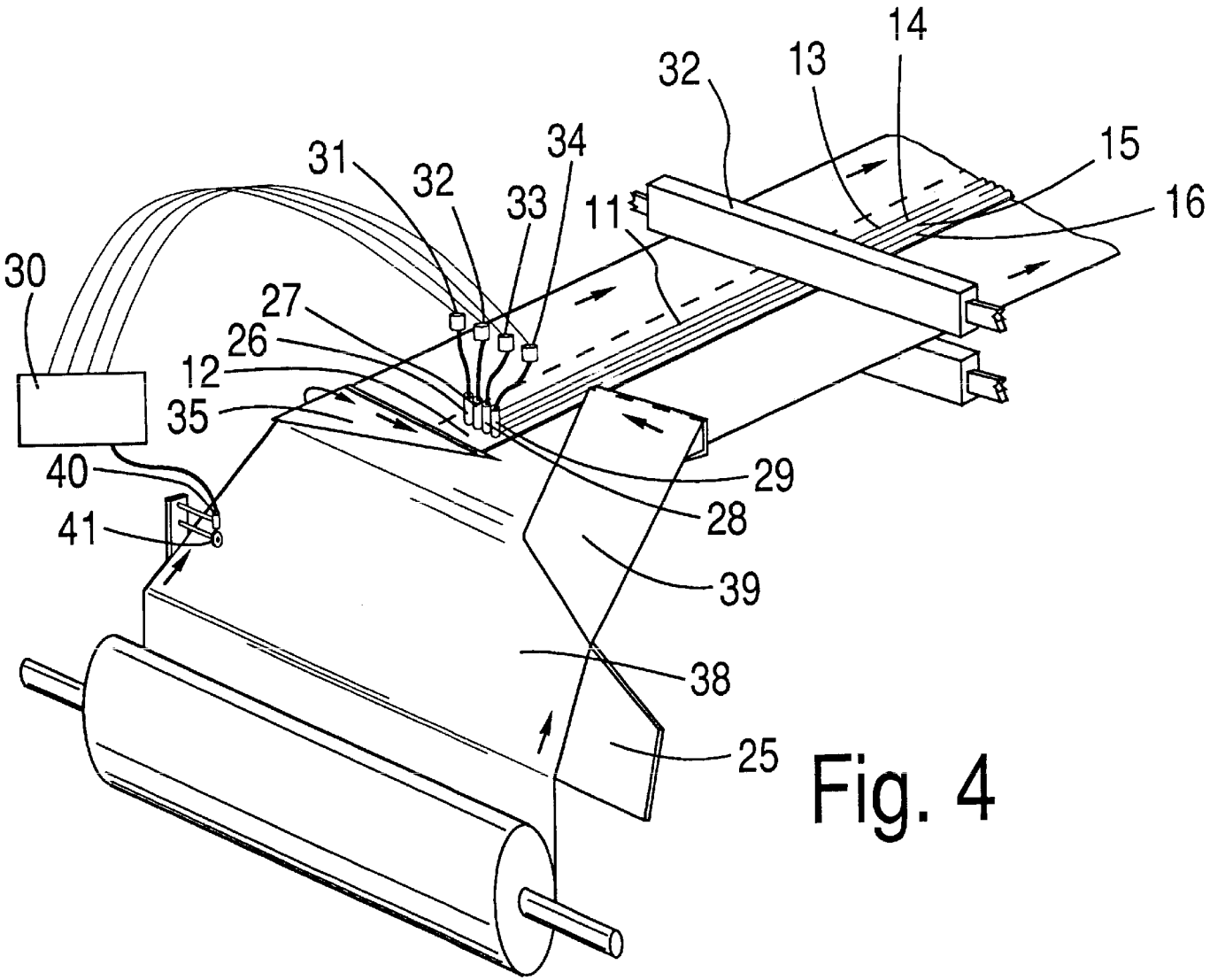
FIG. 4 is a flow diagram of an apparatus for implementing a method for a folding and sealing to form a bag according to the present invention.

Referring now to FIG. 4, a method of manufacturing a bag according to the present invention is disclosed where a continues web of flexible plastic film such as polyethylene is folded at former 25 to form a tube with overlapping margins 11 and 12 where the forming planes use one set of angled planes 35 to form one of the overlapping layers and another angled plane 39 to form the other layer. The different folding angles provides exposure to margin 12 before the folds at margin 11. Hot melt adhesive is applied to margin 12 at 26, 27, 28, and 29 in thin non-continuous streams. The hot melt applicators 26, 27, 28, and 29 intermittently apply the hot melt in such a manner as to create gaps in the streams. A control system 30 such as a micro processor or programmable logic controller systematically activates and deactivates electrical shut-off valves 31, 32, 33, and 34 so that valves 31 and 33 respective to applicators 26 and 28 close and open simultaneously with each other and so that valves 32 and 34 respective to applicators 27 and 29 close and open simultaneously with each other but at a separate interval to 31 and 33. A measuring and signaling device such as a magnetic encoder 40 and magnetic wheel 41 that rolls with the web of film provides a means of signaling the closing and opening of the various valves at measured intervals. Programmable logic controllers, magnetic wheels and encoders are commonly used for measuring a moving web. A cross sealing and cutting-means 32 converts the formed tubing into finished bags. The encoder and controller could also be used to time the intervals with the cross seals so that the cross seals do not block the channel. Both corners of openings must be positioned between the two ends of the bag. Otherwise, if the openings can not be timed with the cross seals, then the distance between the pairs of openings should be less than half of the length of the completed bag to insure that at least one complete channel occurs per bag.

This invention discloses one system of producing the bags according to the present invention. The system includes a forming plane, a continuous web of film, a plurality of hot melt applicators with controllable valves, an encoder or measuring and signaling means, a means of cross sealing, and a controller. Other than the forming plane, all of the components of this system are available and well understood in industry. Certainly numerous other means and seals could be used to produce a bag according to the present invention.

It should be noted that the layers of film forming the channel and the channel itself could be formed either by folding a single web of film around so that the edges overlap, or could be constructed from two or more individual layers of film and in fact could include multiple channels between various layers.

Figure 6A:
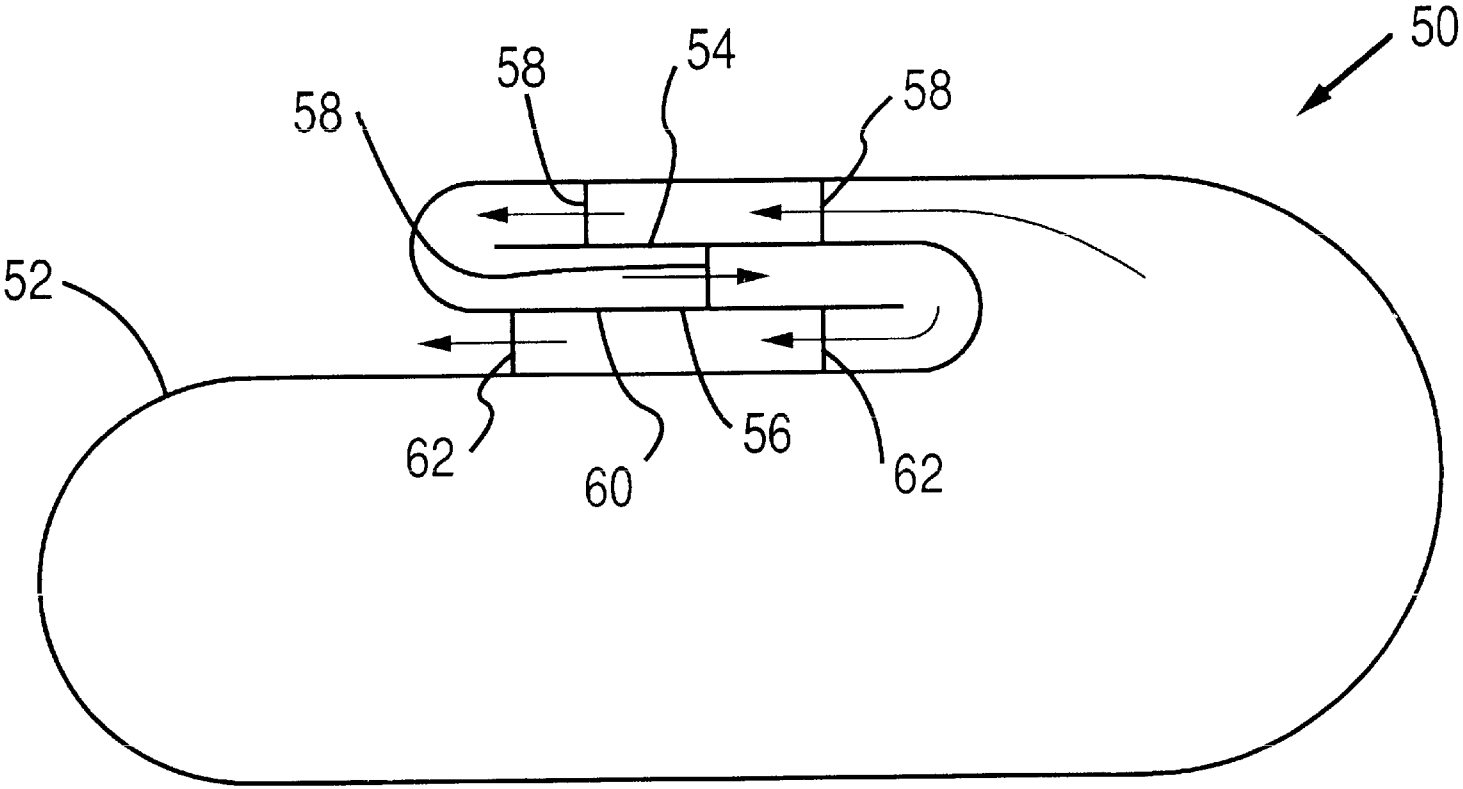
FIG. 6A is a top view illustrating a second alternative embodiment of a bag according to the present invention formed using a single sheet and having three layers of channels formed therein.

FIG. 6A is a top view illustrating a second alternative embodiment of a bag 50 according to the present invention formed using a single sheet 52 and having three layers of channels formed therein. The sheet 52 includes a first side edge folded over an opposite second side edge to form a tube having a longitudinal seam including a first overlapping sheet portion 54 and a second overlapping sheet portion 56 joined together along a plurality of seal lines 58 extending longitudinally from a top edge of the bag to a bottom edge of the bag. Each of the seal lines 58 includes a discontinuity (not shown) proximate one of a top and a bottom edge of the bag. The first overlapping sheet portion 54, second overlapping sheet portion 56, and seal lines 58 form a first channel layer. The bag 50 further includes a third overlapping sheet portion 60 joined to the second overlapping sheet portion 56 along a plurality of second channel layer seal lines 62 extending longitudinally from a top edge of the bag to a bottom edge of the bag. Discontinuities in adjacent ones of the seal lines 62 are disposed proximate opposites ones of the top and bottom edges of the bag 50 such that the plurality of seal lines, the discontinuities, and the second and third overlapping sheet portions form second channel layer. The first channel layer and second channel layer form a tortuous channel providing communication between the interior of the bag and the exterior of the bag.

In an embodiment, the depicted bag 50 is formed according to a method similar to that described above for forming the bag 10 (FIG. 1) and further including an initial step of applying melt adhesive to the third overlapping sheet portion 60, and subsequent steps of heating the third overlapping sheet portion 60 to activate the adhesion folding the second overlapping sheet portion 56 over the adhesive to join the second and third overlapping sheet portions 56 and 60.

Figure 6B:
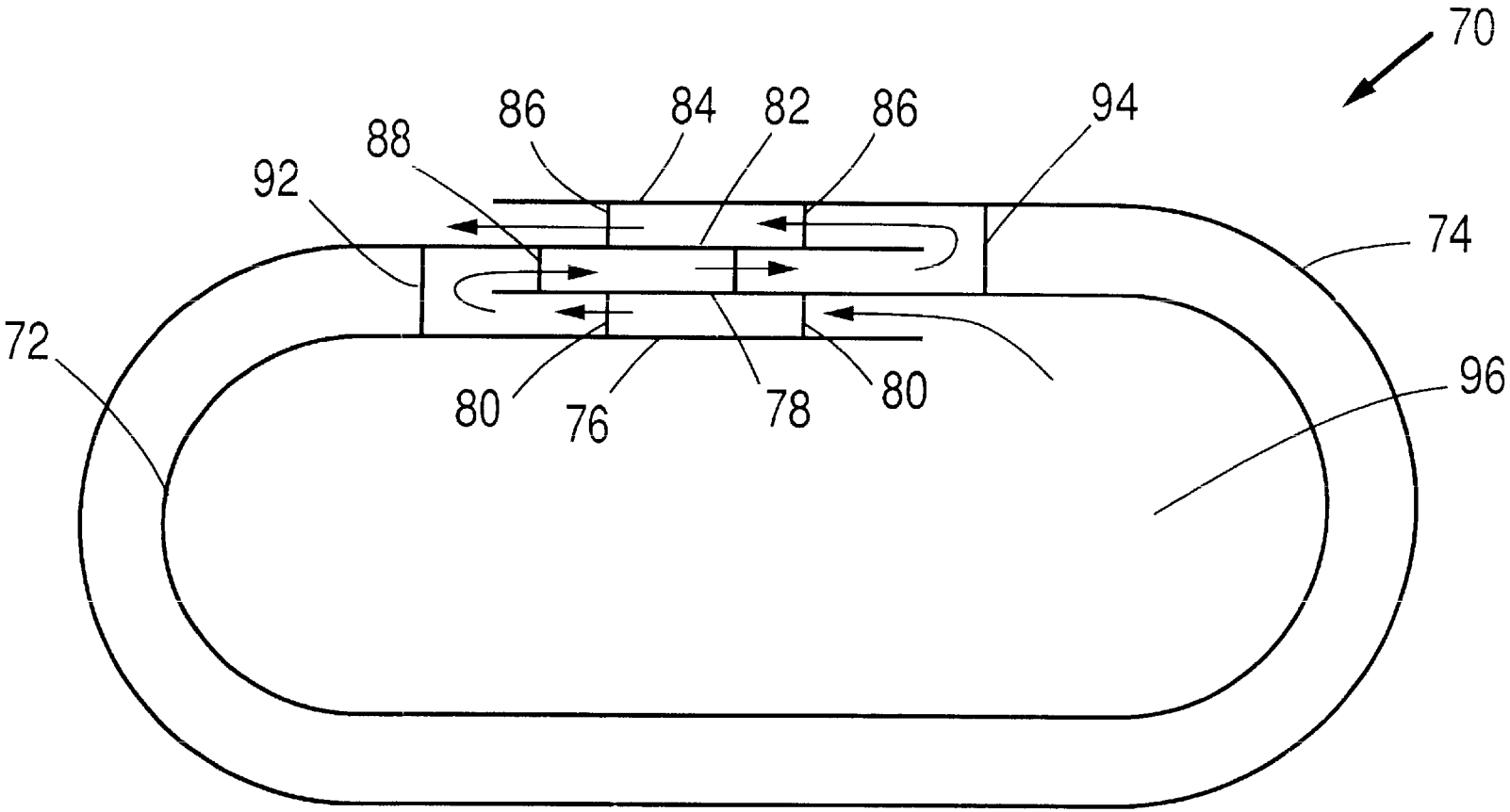
FIG. 6B is a top view illustrating a second alternative embodiment of a bag according to the present invention formed using two sheets and having three layers of channels formed therein.

FIG. 6B is a top view illustrating a second alternative embodiment of a bag 70 according to the present invention formed using a first sheet 72 of substantially gas-impervious material, and a second sheet 74 of substantially gas-impervious material, such as polyethylene. The first sheet 72 includes a first side edge folded over an opposite second side edge to form a first tube having a longitudinal seam including a first overlapping sheet portion 76, and a second overlapping sheet portion 78 joined together along a plurality of seal lines 80 extending longitudinally from a top edge of the bag to a bottom edge of the bag. Each of the seal lines 80 includes a discontinuity (not shown) proximate one of a top and a bottom edge of the bag. The first overlapping sheet portion 76, second overlapping sheet portion 78, and seal lines 80 form a first channel layer.

The second sheet 74 of the bag 70 includes a third side edge folded over an opposite fourth side edge to form a second tube having a longitudinal seam including a third overlapping sheet portion 82 and a fourth overlapping sheet portion 84 joined together along a plurality of seal lines 86 extending longitudinally from said top edge of said sheet to said bottom edge of said sheet. The third overlapping sheet portion 82 is joined to the second side portion 78 along a plurality of seal lines 88 extending longitudinally from said top edge of said sheet to said bottom edge of said sheet, each of said plurality of seal lines including a discontinuity proximate one of said top and bottom edges of said sheet, wherein said discontinuities in adjacent ones of said seal lines 88 are disposed proximate opposites ones of said top and bottom edges of said sheet.

The bag 70 further includes: a first continuous seal line 92 extending longitudinally from the top edge of the bag to the bottom edge of the bag and joining the first and third overlapping sheet portions 76 and 82; and a second continuous seal line 94 extending longitudinally from the top edge of the sheet to the bottom edge of the sheet and joining the second and fourth overlapping sheet portions 78 and 84 together, such that the plurality of seal lines 80, 86, and 88 the first continuous seal line 92, the second continuous seal line 94, the discontinuities (not shown), and the overlapping sheet portions 76, 78, 82, and 84 combine to provide communication between the interior 96 of the bag 70 and the exterior of the bag.

In an alternative embodiment, the depicted bag 70 is formed according to a method similar to that described above for forming the bag 10 (FIG. 1) wherein the second tube is formed over the first tube in accordance with a modified version of the method described in reference to FIG. 4.

There are a variety of alternative configurations for the venting means disclosed herein besides those shown in the preferred embodiment. For example, the seal lines forming the tortuous path do not necessarily need to be parallel, or aligned along the length of the bag. FIG. 7 shows one of the alternative configurations wherein the noncontinuous seals 13, 14, and 14, forming the maze like pattern illustrated in more detail in FIG. 5, are incorporated into an end seal configuration. The bag shown partially broken away at 97 in FIG. 7 could be formed by folding plastic film, or a similar material, so that the edges of the film form overlapping margins 11 and 12 with the margins then sealed together with a continuous seal 14 resulting in the production of a tube. A segment of the tube then would be separated and at least one end thereof would be sealed with noncontinuous seal lines 13, 14 and 15 as shown in FIG. 7. A cross section taken along the line 7*a*—7*a* of FIG. 7*a* reveals channel detail similar to that depicted in FIG. 5. It also is conceivable that pre-manufactured tubing made either by a process similar to the one just described, or by some other process such as extrusion, could be used by cutting a required length of the tubing, and, then sealing one or both ends with non-continuous seals similar to that depicted in FIG. 7.

A number of methods could be employed to form the non-continuous seals shown in FIG. 7. One commonly used method of producing flat seals in plastic bags makes use of heat controlled flat sealing elements applied to the plastic film between a top and bottom sealing bar. A similar method could be used to produce the non-continuous seals of FIG. 7 by providing interrupted spaces in a single line sealing element or in each line of a multiple line sealing element.

Though FIG. 7 demonstrates an alternative configuration of the non-continuous seals, it should be noted that these seals need not traverse the entire width of the bag, and could in fact be placed at any conceivable angle. It is our intention that any reasonable configuration be included in the scope of this invention.

Although the present invention has been particularly shown and described above with reference to specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A vented bag comprising:

a length of generally tubular, substantially gas-impervious material having one end thereof collapsed with facing surfaces joined together, at least a segment of the joined end being sealed by a plurality of at least three spaced apart seal lines extending along said segment, each of said seal lines having a single opening therein, the openings in adjacent ones of said seal lines being disposed proximate opposite ends of the respective lines, the bag being characterized in that between each pair of adjacent seal lines, the width of the portion of the segment of tubular material between the seal lines on one side of the bag is unequal to the width of the corresponding facing portion of material on the other side of the bag such that the facing portions tend to remain separated from each other, whereby a tortuous channel is formed extending through a first of said openings, a first passageway defined by a first pair of said seal lines and the facing portions of said segment disposed therebetween, through a second of said openings and a second passageway defined by a second pair of said seal lines and the facing portions of said segment disposed therebetween, and through a third of said openings, said tortuous channel providing a communicative path for gases between the interior of said bag and the exterior of said bag but tending to form a barrier to passage of liquids or solids.

2. A vented bag as recited in claim 1 wherein said substantially gas-impervious material comprises polyethylene.

3. A vented bag as recited in claim 1 wherein said facing surfaces are joined together along said plurality of seal lines by hot melt adhesive.

4. In a vented bag formed of a tubular shaped length of substantially gas impervious material sealed by a seam along at least one end of said bag, an improved seam comprising:

a plurality of at least three seal lines joining facing portions of said material collapsed together at said one end, each of said seal lines extending in side-by-side spaced apart relationship to each other along said one end, each of said seal lines including a single opening formed proximate an extremity thereof, the openings in adjacent ones of said seal lines being disposed proximate opposite extremities of said seal lines, characterized in that the width of the portion of said material between each pair of adjacent seal lines on one side of the bag is unequal to the width of the corresponding facing portion of material on the other side of the bag, such that the facing portions tend to remain separated from each other, whereby said openings, said adjacent seal lines and the facing portions of said material disposed therebetween form a tortuous channel extending between said seal lines from the interior of said bag and serially through said openings to the exterior of said bag for providing communication of gases between the interior of said bag and the exterior of said bag while inhibiting passage of liquid and solid debris.

5. In a vented bag as recited in claim 4 wherein said substantially gas-impervious material comprises polyethylene.

6. In a vented bag as recited in claim 4 wherein said facing portions are joined together along said plurality of seal lines by hot melt adhesive.

* * * * *